US010726676B2

(12) United States Patent
You et al.

(10) Patent No.: US 10,726,676 B2
(45) **Date of Patent: *Jul. 28, 2020**

(54) GAMING MACHINE INCLUDING ONE OR MORE GROUPED HELD VALUE SYMBOLS

(71) Applicant: Bally Gaming, Inc., Las Vegas, NV (US)

(72) Inventors: Qin You, Randwick (AU); Yanhua Yin, Newington (AU); Peter Wilkins, Curl Curl (AU); Elizabeth Carter, Chicago, IL (US); Jack Chesworth, Hurlstone Park (AU); Ross Malcolm Gilbertson, Ultimo (AU)

(73) Assignee: SG Gaming, Inc., Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/515,204

(22) Filed: Jul. 18, 2019

(65) Prior Publication Data

US 2019/0340880 A1 Nov. 7, 2019

Related U.S. Application Data

(63) Continuation of application No. 15/190,536, filed on Jun. 23, 2016, now Pat. No. 10,388,112.

(51) Int. Cl.
*G07F 17/34* (2006.01)
*G07F 17/32* (2006.01)

(52) U.S. Cl.
CPC ..... *G07F 17/3267* (2013.01); *G07F 17/3213* (2013.01); *G07F 17/3225* (2013.01); *G07F 17/34* (2013.01)

(58) Field of Classification Search
CPC ..... G07F 17/3213; G07F 17/3225; G07F 17/3265; G07F 17/3267; G07F 17/34
See application file for complete search history.

(56) References Cited

U.S. PATENT DOCUMENTS 3,733,075 A 5/1973 Burnside et al.
5,342,047 A 8/1994 Heidel et al.
5,356,140 A 10/1994 Dabrowski et al.
(Continued)

FOREIGN PATENT DOCUMENTS

AU 2015210489 A1 2/2016
GB 2097160 B 5/1984
(Continued)

*Primary Examiner* — Jasson H Yoo

(57) ABSTRACT

Disclosed is a gaming system including a gaming machine. In response to a triggering event, the gaming system initiates play of a feature game including a plurality of standard symbols and value symbols, the value symbols being associated with one or more values. Value symbols adjacent to one another are combined into a larger composite symbol and held in place on a display device, the standard symbols then replaced with replacement symbols randomly selected from the standard and value symbols. When the replacement symbols include another value symbol adjacent to the composite symbol, the new value symbol is also combined with the composite symbol, increasing its size. At the conclusion of the feature game, a reel associated with the composite symbol is displayed and spun to select an award from a set of possible awards based on the size of the composite symbol.

18 Claims, 13 Drawing Sheets

(56) References Cited

U.S. PATENT DOCUMENTS

| | | | |
|---|---|---|---|
| 5,393,061 | A | 2/1995 | Manship et al. |
| 5,704,835 | A | 1/1998 | Dietz |
| 5,833,537 | A | 11/1998 | Barrie |
| 5,951,397 | A | 9/1999 | Dickinson |
| 6,056,642 | A | 5/2000 | Bennett |
| 6,641,477 | B1 | 11/2003 | Dietz, II |
| 6,910,962 | B2 | 6/2005 | Marks et al. |
| 7,018,293 | B2 | 3/2006 | Brown et al. |
| 7,503,847 | B2 | 3/2009 | Baerlocher |
| 7,553,231 | B2 | 6/2009 | Rodgers et al. |
| 7,604,538 | B2 | 10/2009 | Pacey |
| 8,083,581 | B2 | 12/2011 | Marks et al. |
| 8,105,151 | B2 | 1/2012 | Caputo et al. |
| 8,192,275 | B2 | 6/2012 | Aoki et al. |
| 8,287,357 | B2 | 10/2012 | Evans |
| 8,323,091 | B2 | 12/2012 | Frank et al. |
| 8,357,041 | B1 | 1/2013 | Saunders |
| 8,366,538 | B1 | 2/2013 | Saunders et al. |
| 8,371,930 | B1 | 2/2013 | Saunders et al. |
| 8,414,380 | B2 | 4/2013 | Saunders et al. |
| 8,465,358 | B2 | 6/2013 | Kemper |
| 8,496,522 | B2 | 7/2013 | Caputo et al. |
| 8,512,138 | B2 | 8/2013 | Saunders |
| 8,523,659 | B2 | 9/2013 | Evans |
| 8,574,059 | B2 | 11/2013 | Rodgers et al. |
| 8,608,545 | B2 | 12/2013 | Arora et al. |
| 8,662,986 | B2 | 3/2014 | Rodgers et al. |
| 8,690,660 | B2 | 4/2014 | Saunders et al. |
| 8,790,169 | B2 | 7/2014 | Saunders |
| 8,851,974 | B2 | 10/2014 | Caputo et al. |
| 8,870,642 | B2 | 10/2014 | Leupp et al. |
| 8,882,578 | B2 | 11/2014 | Saunders |
| 8,961,291 | B2 | 2/2015 | Dias Pires et al. |
| 9,005,022 | B2 | 4/2015 | Saunders |
| 9,165,433 | B2 | 10/2015 | Caputo |
| 9,230,410 | B2 | 1/2016 | Saunders et al. |
| 9,245,421 | B2 | 1/2016 | Saunders et al. |
| 9,251,667 | B2 | 2/2016 | Marks et al. |
| 9,257,017 | B2 | 2/2016 | Saunders et al. |
| 9,262,895 | B2 | 2/2016 | Rodgers et al. |
| 9,275,524 | B2 | 3/2016 | Nicely |
| 9,299,224 | B2 | 3/2016 | Leupp |
| 9,311,781 | B2 | 4/2016 | Edwards |
| 9,349,251 | B2 | 5/2016 | Caputo et al. |
| 9,355,528 | B2 | 5/2016 | Nicely |
| 10,388,112 | B2 * | 8/2019 | You ..... G07F 17/34 |
| 2007/0060248 | A1 | 3/2007 | Rodgers et al. |
| 2009/0291741 | A1 | 11/2009 | Schofield |
| 2010/0075737 | A1 | 3/2010 | Bluemel |
| 2014/0141860 | A1 * | 5/2014 | Meyer ..... G07F 17/3267 463/21 |
| 2016/0042597 | A1 | 2/2016 | Olive |

FOREIGN PATENT DOCUMENTS

| | | | |
|---|---|---|---|
| GB | 2144568 | B | 9/1985 |
| GB | 2251112 | A | 6/1992 |

* cited by examiner

GAMING MACHINE INCLUDING ONE OR MORE GROUPED HELD VALUE SYMBOLS

CROSS REFERENCE TO RELATED APPLICATIONS

The present application is a continuation of of U.S. patent application Ser. No. 15/190,536 filed Jun. 23, 2016, the disclosure of which is hereby incorporated by reference in its entirety herein.

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to gaming machines, systems, apparatus, and methods and, more particularly, to gaming machines, systems, apparatus, and methods including one or more grouped held value symbols.

BACKGROUND OF THE INVENTION

The gaming industry depends upon player participation. Players are generally "hopeful" players who either think they are lucky or at least think they can get lucky—for a relatively small investment to play a game, they can get a disproportionately large return. To create this feeling of luck, a gaming apparatus relies upon an internal or external random element generator to generate one or more random elements such as random numbers. The gaming apparatus determines a game outcome based, at least in part, on the one or more random elements.

A significant technical challenge is to improve the operation of gaming apparatus and games played thereon, including the manner in which they leverage the underlying random element generator, by making them yield a negative return on investment in the long run (via a high quantity and/or frequency of player/apparatus interactions) and yet random and volatile enough to make players feel they can get lucky and win in the short run. Striking the right balance between yield versus randomness and volatility to create a feeling of luck involves addressing many technical problems, some of which can be at odds with one another. This luck factor is what appeals to core players and encourages prolonged and frequent player participation. As the industry matures, the creativity and ingenuity required to improve such operation of gaming apparatus and games grows accordingly.

Another significant technical challenge is to improve the operation of gaming apparatus and games played thereon by increasing processing speed and efficiency of usage of processing and/or memory resources. To make games more entertaining and exciting, they often offer the complexities of advanced graphics and special effects, multiple bonus features with different game formats, and multiple random outcome determinations per feature. The game formats may, for example, include picking games, reel spins, wheel spins, and other arcade-style play mechanics. Inefficiencies in processor execution of the game software can slow down play of the game and prevent a player from the playing the game at their desired pace.

SUMMARY OF THE INVENTION

According to certain aspects of the present invention, a gaming system includes a regulated gaming machine primarily dedicated for use in playing at least one regulated casino wagering game. The gaming machine includes an electronic display device and one or more electronic input devices and game-logic circuitry configured to detect, via at least one of the one or more electronic input devices, a physical item associated with a monetary value that establishes a credit balance and to initiate the casino wagering game in response to an input indicative of a wager covered by the credit balance. In response to a triggering event: the game logic circuitry is further configured to initiate play of a feature game including randomly selecting a set of symbols from a plurality of symbols, the plurality of symbols including standard symbols and value symbols and to display the set of symbols in an array on the electronic display device. The value symbols are associated with one or more values and are held in place in a group on the electronic display device. One or more of the standard symbols are replaced with respective replacement symbols randomly selected from the plurality of symbols. In response to the replacement symbols including another one or more of the value symbols, the new value symbols may be added to the group and at least one of the values of the symbols previously in the group is modified. At the conclusion of the feature game, an award based on the cumulative current value of the held value symbols is determined. At the conclusion of game play, the game-logic circuitry is configured to receive, via at least one of the one or more electronic input devices, a cashout input that initiates a payout from the credit balance.

According to other aspects of the present invention, a gaming system includes a regulated gaming machine primarily dedicated for use in playing at least one regulated casino wagering game. The gaming machine includes an electronic display device and one or more electronic input devices and means for detecting, via at least one of the one or more electronic input devices, a physical item associated with a monetary value that establishes a credit balance and for initiating the casino wagering game in response to an input indicative of a wager covered by the credit balance. In response to a triggering event: the gaming system further includes: means for initiating play of a feature game including randomly selecting a set of symbols from a plurality of symbols, the plurality of symbols including standard symbols and value symbols; means for displaying the set of symbols in an array on the electronic display device, the value symbols being associated with one or more values; means for holding one or more of the value symbols in place in a group on the electronic display device; means for replacing one or more of the standard symbols with respective replacement symbols randomly selected from the plurality of symbols; and, when the replacement symbols include another one or more of the value symbols, means for adding the another one or more of the value symbols to the group and for modifying at least one of the values of the symbols previously in the group; and means for awarding the current cumulative value of the held value symbols. At the conclusion of game play, the gaming system also includes means for receiving, via at least one of the one or more electronic input devices, a cashout input that initiates a payout from the credit balance.

In accordance with another embodiment, a method of operating a gaming system that includes a regulated gaming machine primarily dedicated for use in playing at least one regulated casino wagering game, the gaming machine including an electronic display device and one or more electronic input devices and game-logic circuitry for detecting, via at least one of the one or more electronic input devices, a physical item associated with a monetary value that establishes a credit balance includes the step of initiating the casino wagering game in response to an input indicative of a wager covered by the credit balance. In response to a triggering event: the method further includes steps for: initiating play of a feature game including randomly selecting a set of symbols from a plurality of symbols, the plurality of symbols including standard symbols and value symbols; for displaying the set of symbols in an array on the electronic display device, the value symbols being associated with one or more values; for holding one or more of the value symbols in place in a group on the electronic display device; for replacing one or more of the standard symbols with respective replacement symbols randomly selected from the plurality of symbols; and, in response to the replacement symbols including another one or more of the value symbols, for adding the another one or more of the value symbols to the group and for modifying at least one of the values of the symbols previously in the group; and for awarding the cumulative current value of the held value symbols. At the conclusion of game play, the method includes the step of receiving, via at least one of the one or more electronic input devices, a cashout input that initiates a payout from the credit balance.

Additional aspects of the invention will be apparent to those of ordinary skill in the art in view of the detailed description of various embodiments, which is made with reference to the drawings, a brief description of which is provided below.

Figure 1:
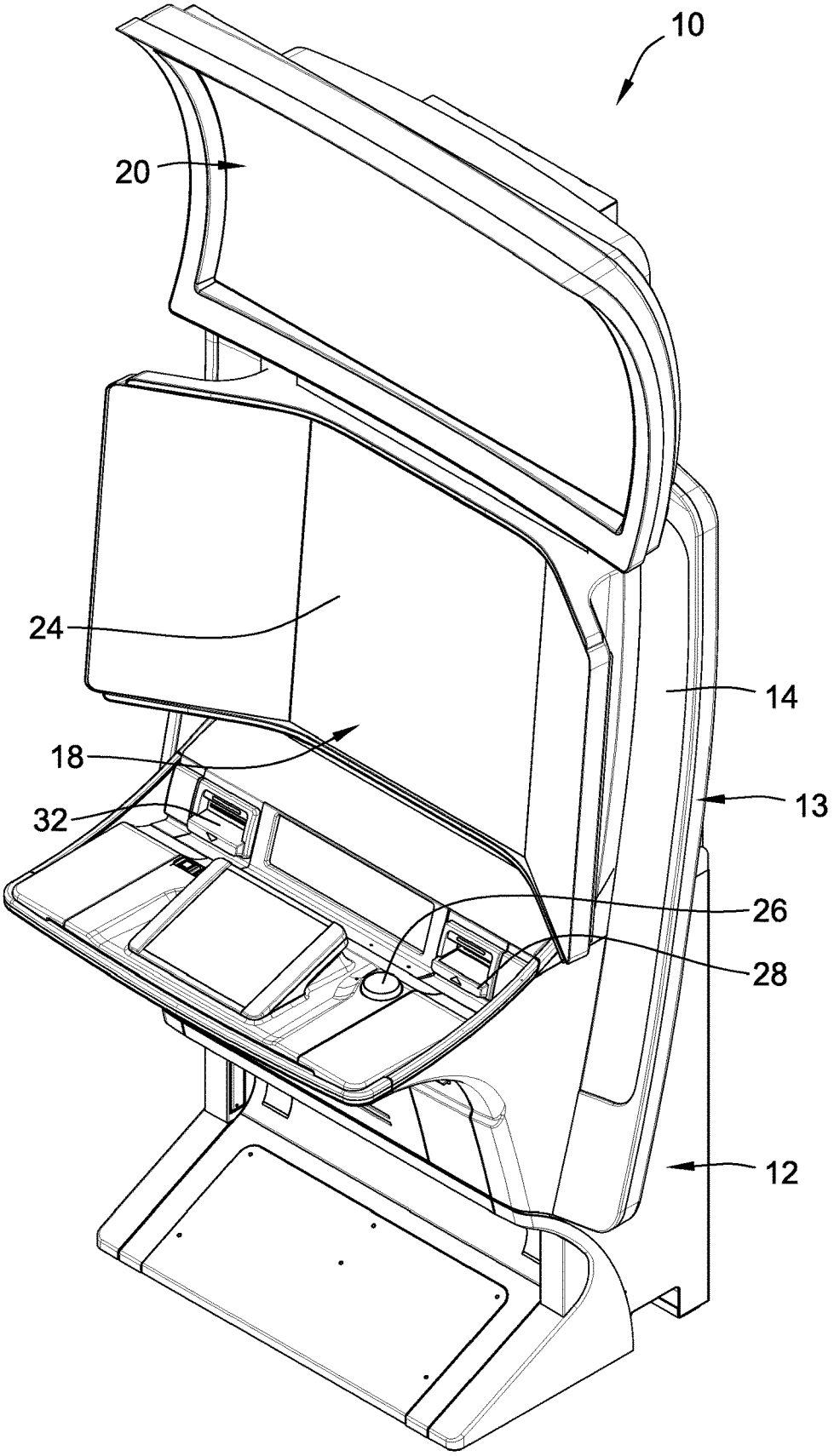
FIG. 1 is a perspective view of a free-standing gaming machine according to an embodiment of the present invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated. For purposes of the present detailed description, the singular includes the plural and vice versa (unless specifically disclaimed); the words "and" and "or" shall be both conjunctive and disjunctive; the word "all" means "any and all"; the word "any" means "any and all"; and the word "including" means "including without limitation."

For purposes of the present detailed description, the terms "wagering game," "casino wagering game," "gambling," "slot game," "casino game," and the like include games in which a player places at risk a sum of money or other representation of value, whether or not redeemable for cash, on an event with an uncertain outcome, including without limitation those having some element of skill. In some embodiments, the wagering game may be subject to approval for use in one of more regulated gaming jurisdictions. In some embodiments, the wagering game involves wagers of real money, as found with typical land-based or online casino games. In other embodiments, the wagering game additionally, or alternatively, involves wagers of non-cash values, such as virtual currency, and therefore may be considered a social or casual game, such as would be typically available on a social networking web site, other web sites, across computer networks, or applications on mobile devices (e.g., phones, tablets, etc.). When provided in a social or casual game format, the wagering game may closely resemble a traditional casino game, or it may take another form that more closely resembles other types of social/casual games.

Referring to FIG. 1, there is shown a gaming machine 10 similar to those operated in gaming establishments, such as casinos. With regard to the present invention, the gaming machine 10 may be any type of gaming terminal or machine and may have varying structures and methods of operation. For example, in some aspects, the gaming machine 10 is an electromechanical gaming terminal configured to play mechanical slots, whereas in other aspects, the gaming machine is an electronic gaming terminal configured to play a video casino game, such as slots, keno, poker, blackjack, roulette, craps, etc. The gaming machine 10 may take any suitable form, such as floor-standing models as shown, handheld mobile units, bartop models, workstation-type console models, etc. Further, the gaming machine 10 may be primarily dedicated for use in playing wagering games, or may include non-dedicated devices, such as mobile phones, personal digital assistants, personal computers, etc. Exemplary types of gaming machines are disclosed in U.S. Pat. Nos. 6,517,433, 8,057,303, and 8,226,459, which are incorporated herein by reference in their entireties.

The gaming machine 10 illustrated in FIG. 1 comprises a gaming cabinet 12 that securely houses various input devices, output devices, input/output devices, internal electronic/electromechanical components, and wiring. The cabinet 12 includes exterior walls, interior walls and shelves for mounting the internal components and managing the wiring, and one or more front doors that are locked and require a physical or electronic key to gain access to the interior compartment of the cabinet 12 behind the locked door. The cabinet 12 optionally forms an alcove configured to store one or more beverages or personal items of a player. A notification mechanism, such as a candle or tower light, is optionally mounted to the top of the cabinet 12. It flashes to alert an attendant that change is needed, a hand pay is requested, or there is a potential problem with the gaming machine 10. The gaming cabinet 12 optionally includes a rear wing 13 having a front surface 14 that is positioned rearward of a primary display 18.

The input devices, output devices, and input/output devices are disposed on, and securely coupled to, the cabinet 12. By way of example, the output devices include the primary display 18, a secondary display 20, and one or more audio speakers. The primary display 18 or the secondary display 20 may be a mechanical-reel display device, a video display device, or a combination thereof in which a transmissive video display is disposed in front of the mechanical-reel display to portray a video image superimposed upon the mechanical-reel display. The displays variously display information associated with wagering games, non-wagering games, community games, progressives, advertisements, services, premium entertainment, text messaging, emails, alerts, announcements, broadcast information, subscription information, etc. appropriate to the particular mode(s) of operation of the gaming machine 10. The gaming machine 10 includes a touch screen(s) 24 mounted over the primary or secondary displays, one or more buttons 26 on a button panel and/or other player-input devices, a bill/ticket acceptor 28, a card reader/writer and/or ticket dispenser 32, and player-accessible ports (e.g., audio output jack for headphones, video headset jack, USB port, wireless transmitter/receiver, etc.). It should be understood that numerous other peripheral devices and other elements exist and are readily utilizable in any number of combinations to create various forms of a gaming machine in accord with the present concepts.

The player input devices, such as the touch screen 24, buttons 26, a mouse, a joystick, a gesture-sensing device, a voice-recognition device, and a virtual-input device, accept player inputs and transform the player inputs to electronic data signals indicative of the player inputs, which correspond to an enabled feature for such inputs at a time of activation (e.g., pressing a "Max Bet" button or soft key to indicate a player's desire to place a maximum wager to play the wagering game). The inputs, once transformed into electronic data signals, are output to game-logic circuitry for processing. The electronic data signals are selected from a group consisting essentially of an electrical current, an electrical voltage, an electrical charge, an optical signal, an optical element, a magnetic signal, and a magnetic element.

The gaming machine 10 includes one or more value input/payment devices and value output/payout devices. The value input devices are used to deposit cash or credits onto the gaming machine 10. The cash or credits are used to fund wagers placed on the wagering game played via the gaming machine 10. Examples of value input devices include, but are not limited to, a coin acceptor, the bill/ticket acceptor 28, the card reader/writer 30, a wireless communication interface for reading cash or credit data from a nearby mobile device, and a network interface for withdrawing cash or credits from a remote account via an electronic funds transfer. A value input device is configured to detect a physical item, such as coins, currency, cards, etc., associated with a monetary value that establishes a credit balance on a credit meter such as the "credits" meter 84 (see FIG. 3). In response to a cashout input that initiates a payout from the credit balance on the "credits" meter 84, the value output devices are used to dispense cash or credits from the gaming machine 10. The credits may be exchanged for cash at, for example, a cashier or redemption station. Examples of value output devices include, but are not limited to, a coin hopper for dispensing coins or tokens, a bill dispenser, the card reader/writer 30, the ticket dispenser 32 for printing tickets redeemable for cash or credits, a wireless communication interface for transmitting cash or credit data to a nearby mobile device, and a network interface for depositing cash or credits to a remote account via an electronic funds transfer.

Figure 2:
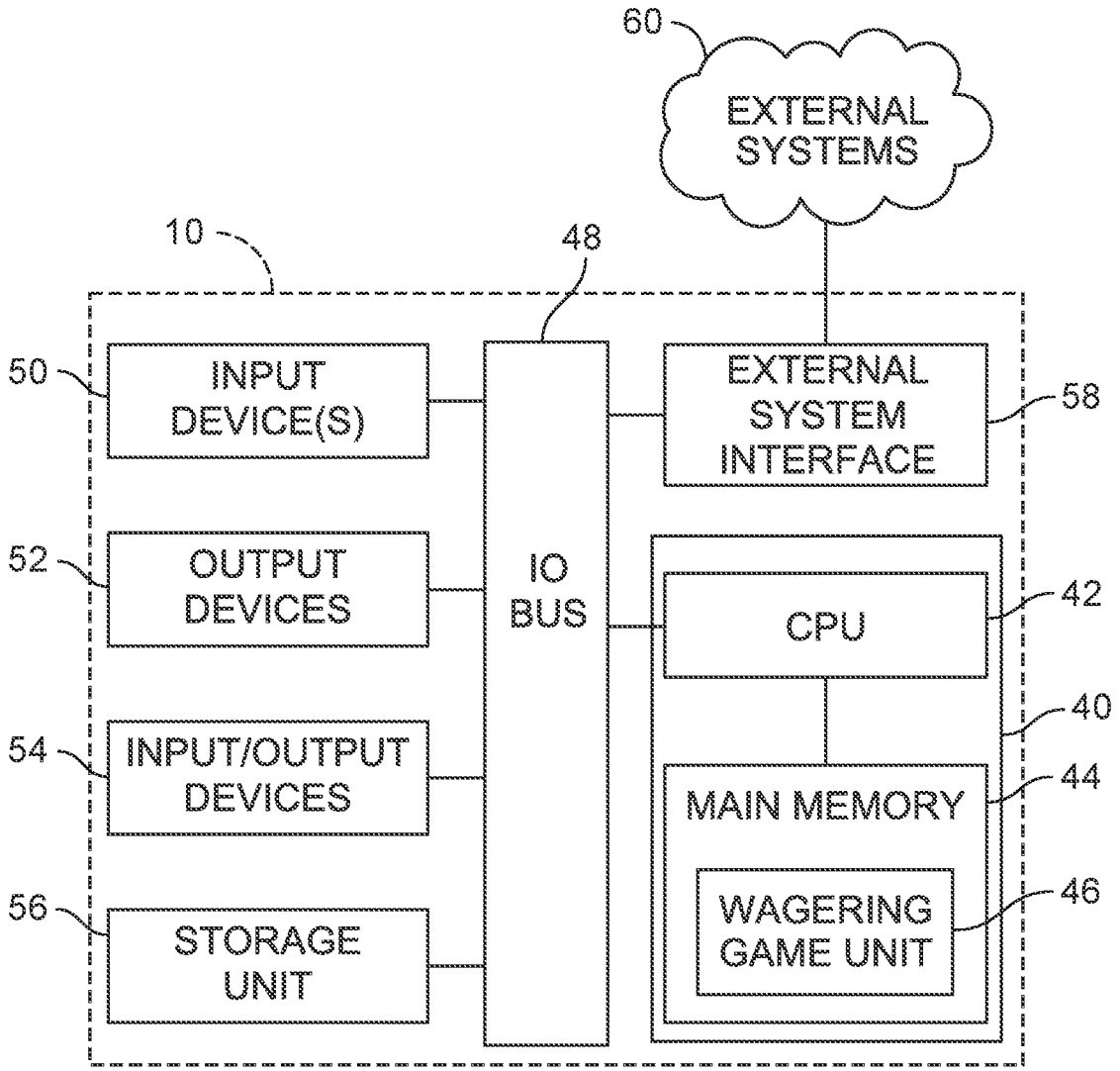
FIG. 2 is a schematic view of a gaming system according to an embodiment of the present invention.

Turning now to FIG. 2, there is shown a block diagram of the gaming-machine architecture. The gaming machine 10 includes game-logic circuitry 40 securely housed within a locked box inside the gaming cabinet 12 (see FIG. 1). The game-logic circuitry 40 includes a central processing unit (CPU) 42 connected to a main memory 44 that comprises one or more memory devices. The CPU 42 includes any suitable processor(s), such as those made by Intel and AMID. By way of example, the CPU 42 includes a plurality of microprocessors including a master processor, a slave processor, and a secondary or parallel processor. Game-logic circuitry 40, as used herein, comprises any combination of hardware, software, or firmware disposed in or outside of the gaming machine 10 that is configured to communicate with or control the transfer of data between the gaming machine 10 and a bus, another computer, processor, device, service, or network. The game-logic circuitry 40, and more specifically the CPU 42, comprises one or more controllers or processors and such one or more controllers or processors need not be disposed proximal to one another and may be located in different devices or in different locations. The game-logic circuitry 40, and more specifically the main memory 44, comprises one or more memory devices which need not be disposed proximal to one another and may be located in different devices or in different locations. The game-logic circuitry 40 is operable to execute all of the various gaming methods and other processes disclosed herein. The main memory 44 includes a wagering-game unit 46. In one embodiment, the wagering-game unit 46 causes wagering games to be presented, such as video poker, video blackjack, video slots, video lottery, etc., in whole or part.

The game-logic circuitry 40 is also connected to an input/output (I/O) bus 48, which can include any suitable bus technologies, such as an AGTL+ frontside bus and a PCI backside bus. The I/O bus 48 is connected to various input devices 50, output devices 52, and input/output devices 54 such as those discussed above in connection with FIG. 1. The I/O bus 48 is also connected to a storage unit 56 and an external-system interface 58, which is connected to external system(s) 60 (e.g., wagering-game networks).

The external system 60 includes, in various aspects, a gaming network, other gaming machines or terminals, a gaming server, a remote controller, communications hardware, or a variety of other interfaced systems or components, in any combination. In yet other aspects, the external system 60 comprises a player's portable electronic device (e.g., cellular phone, electronic wallet, etc.) and the external-system interface 58 is configured to facilitate wireless communication and data transfer between the portable electronic device and the gaming machine 10, such as by a near-field communication path operating via magnetic-field induction or a frequency-hopping spread spectrum RF signals (e.g., Bluetooth, etc.).

The gaming machine 10 optionally communicates with the external system 60 such that the gaming machine 10 operates as a thin, thick, or intermediate client. The game-logic circuitry 40—whether located within ("thick client"), external to ("thin client"), or distributed both within and external to ("intermediate client") the gaming machine 10—is utilized to provide a wagering game on the gaming machine 10. In general, the main memory 44 stores programming for a random number generator (RNG), game-outcome logic, and game assets (e.g., art, sound, etc.)—all of which obtained regulatory approval from a gaming control board or commission and are verified by a trusted authentication program in the main memory 44 prior to game execution. The authentication program generates a live authentication code (e.g., digital signature or hash) from the memory contents and compare it to a trusted code stored in the main memory 44. If the codes match, authentication is deemed a success and the game is permitted to execute. If, however, the codes do not match, authentication is deemed a failure that must be corrected prior to game execution. Without this predictable and repeatable authentication, the gaming machine 10, external system 60, or both are not allowed to perform or execute the RNG programming or game-outcome logic in a regulatory-approved manner and are therefore unacceptable for commercial use. In other words, through the use of the authentication program, the game-logic circuitry facilitates operation of the game in a way that a person making calculations or computations could not.

When a wagering-game instance is executed, the CPU 42 (comprising one or more processors or controllers) executes the RNG programming to generate one or more pseudo-random numbers. The pseudo-random numbers are divided into different ranges, and each range is associated with a respective game outcome. Accordingly, the pseudo-random numbers are utilized by the CPU 42 when executing the game-outcome logic to determine a resultant outcome for that instance of the wagering game. The resultant outcome is then presented to a player of the gaming machine 10 by accessing the associated game assets, required for the resultant outcome, from the main memory 44. The CPU 42 causes the game assets to be presented to the player as outputs from the gaming machine 10 (e.g., audio and video presentations). Instead of a pseudo-RNG, the game outcome may be derived from random numbers generated by a physical RNG that measures some physical phenomenon that is expected to be random and then compensates for possible biases in the measurement process. Whether the RNG is a pseudo-RNG or physical RNG, the RNG uses a seeding process that relies upon an unpredictable factor (e.g., human interaction of turning a key) and cycles continuously in the background between games and during game play at a speed that cannot be timed by the player, for example, at a minimum of 100 Hz (100 calls per second) as set forth in Nevada's New Gaming Device Submission Package. Accordingly, the RNG cannot be carried out manually by a human and is integral to operating the game. For purposes of the present detailed description, the term "randomly determine" or "randomly select" is intended to include the use of either a pseudo-RNG or physical RNG in the determination of a value, outcome or element.

The gaming machine 10 may be used to play central determination games, such as electronic pull-tab and bingo games. In an electronic pull-tab game, the RNG is used to randomize the distribution of outcomes in a pool and/or to select which outcome is drawn from the pool of outcomes when the player requests to play the game. In an electronic bingo game, the RNG is used to randomly draw numbers that players match against numbers printed on their electronic bingo card.

The gaming machine 10 may include additional peripheral devices or more than one of each component shown in FIG. 2. Any component of the gaming-machine architecture includes hardware, firmware, or tangible machine-readable storage media including instructions for performing the operations described herein. Machine-readable storage media includes any mechanism that stores information and provides the information in a form readable by a machine (e.g., gaming terminal, computer, etc.). For example, machine-readable storage media includes read only memory (ROM), random access memory (RAM), magnetic-disk storage media, optical storage media, flash memory, etc.

Figure 3:
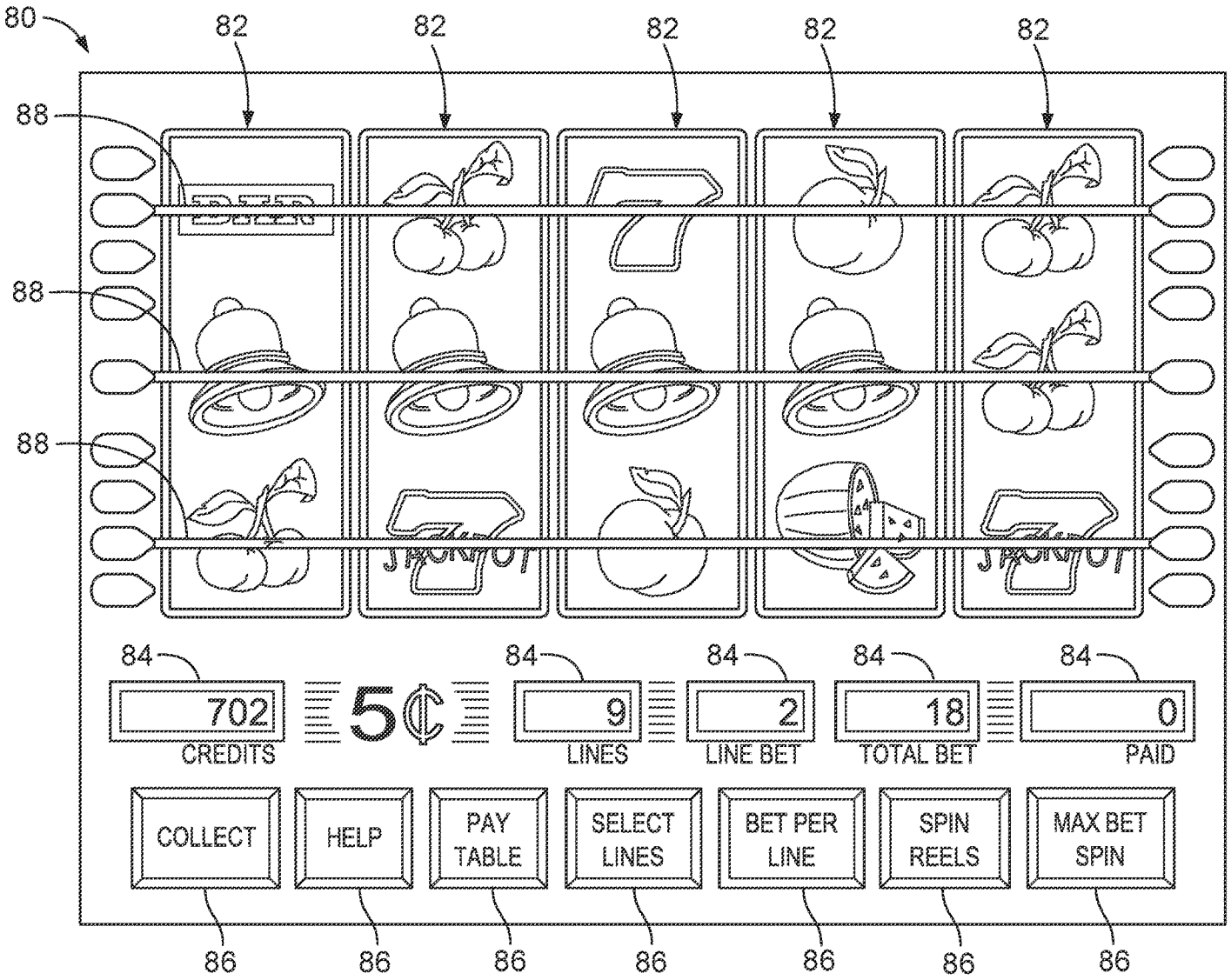
FIG. 3 is an image of an exemplary basic-game screen of a wagering game displayed on a gaming machine, according to an embodiment of the present invention.

Referring now to FIG. 3, in accordance with one or more embodiments, there is illustrated an image of a basic-game screen 80 adapted to be displayed on the primary display 18 or the secondary display 20. The basic-game screen 80 portrays a plurality of simulated symbol-bearing reels 82. Alternatively or additionally, the basic-game screen 80 portrays a plurality of mechanical reels or other video or mechanical presentation consistent with the game format and theme. One advantage of simulating the plurality of symbol bearing reels over using actual mechanical reels driven by stepper motors, for example, is a reduction in the real-time processing required by CPU 42. The basic-game screen 80 also advantageously displays one or more game-session credit meters 84 and various touch screen buttons 86 adapted to be actuated by a player. A player can operate or interact with the wagering game using these touch screen buttons or other input devices such as the buttons 26 shown in FIG. 1. The game-logic circuitry 40 operates to execute a wagering-game program causing the primary display 18 or the secondary display 20 to display the wagering game.

In response to receiving an input indicative of a wager covered by the credit balance on the "credits" meter 84, the reels 82 are rotated and stopped to place symbols on the reels in visual association with paylines such as paylines 88. The wagering game evaluates the displayed array of symbols on the stopped reels and provides immediate awards and bonus features in accordance with a pay table. The pay table may, for example, include "line pays" or "scatter pays." Line pays occur when a predetermined type and number of symbols appear along an activated payline, typically in a particular order such as left to right, right to left, top to bottom, bottom to top, etc. Scatter pays occur when a predetermined type and number of symbols appear anywhere in the displayed array without regard to position or paylines. Similarly, the wagering game may trigger bonus features based on one or more bonus triggering symbols appearing along an activated payline (i.e., "line trigger") or anywhere in the displayed array (i.e., "scatter trigger"). The wagering game may also provide mystery awards and features independent of the symbols appearing in the displayed array.

In accord with various methods of conducting a wagering game on a gaming system in accord with the present concepts, the wagering game includes a game sequence in which a player makes a wager and a wagering-game outcome is provided or displayed in response to the wager being received or detected. The wagering-game outcome, for that particular wagering-game instance, is then revealed to the player in due course following initiation of the wagering game. The method comprises the acts of conducting the wagering game using a gaming apparatus, such as the gaming machine 10 depicted in FIG. 1, following receipt of an input from the player to initiate a wagering-game instance. The gaming machine 10 then communicates the wagering-game outcome to the player via one or more output devices (e.g., primary display 18 or secondary display 20) through the display of information such as, but not limited to, text, graphics, static images, moving images, etc., or any combination thereof. In accord with the method of conducting the wagering game, the game-logic circuitry 40 transforms a physical player input, such as a player's pressing of a "Spin Reels" touch key, into an electronic data signal indicative of an instruction relating to the wagering game (e.g., an electronic data signal bearing data on a wager amount).

In the aforementioned method, for each data signal, the game-logic circuitry 40 is configured to process the electronic data signal, to interpret the data signal (e.g., data signals corresponding to a wager input), and to cause further actions associated with the interpretation of the signal in accord with stored instructions relating to such further actions executed by the controller. As one example, the CPU 42 causes the recording of a digital representation of the wager in one or more storage media (e.g., storage unit 56), the CPU 42, in accord with associated stored instructions, causes the changing of a state of the storage media from a first state to a second state. This change in state is, for example, effected by changing a magnetization pattern on a magnetically coated surface of a magnetic storage media or changing a magnetic state of a ferromagnetic surface of a magneto-optical disc storage media, a change in state of transistors or capacitors in a volatile or a non-volatile semiconductor memory (e.g., DRAM, etc.). The noted second state of the data storage media comprises storage in the storage media of data representing the electronic data signal from the CPU 42 (e.g., the wager in the present example). As another example, the CPU 42 further, in accord with the execution of the stored instructions relating to the wagering game, causes the primary display 18, other display device, or other output device (e.g., speakers, lights, communication device, etc.) to change from a first state to at least a second state, wherein the second state of the primary display comprises a visual representation of the physical player input (e.g., an acknowledgement to a player), information relating to the physical player input (e.g., an indication of the wager amount), a game sequence, an outcome of the game sequence, or any combination thereof, wherein the game sequence in accord with the present concepts comprises acts described herein. The aforementioned executing of the stored instructions relating to the wagering game is further conducted in accord with a random outcome (e.g., determined by the RNG) that is used by the game-logic circuitry 40 to determine the outcome of the wagering-game instance. In at least some aspects, the game-logic circuitry 40 is configured to determine an outcome of the wagering-game instance at least partially in response to the random parameter.

In one embodiment, the gaming machine 10 and, additionally or alternatively, the external system 60 (e.g., a gaming server), means gaming equipment that meets the hardware and software requirements for fairness, security, and predictability as established by at least one state's gaming control board or commission. Prior to commercial deployment, the gaming machine 10, the external system 60, or both and the casino wagering game played thereon may need to satisfy minimum technical standards and require regulatory approval from a gaming control board or commission (e.g., the Nevada Gaming Commission, Alderney Gambling Control Commission, National Indian Gaming Commission, etc.) charged with regulating casino and other types of gaming in a defined geographical area, such as a state. By way of non-limiting example, a gaming machine in Nevada means a device as set forth in NRS 463.0155, 463.0191, and all other relevant provisions of the Nevada Gaming Control Act, and the gaming machine cannot be deployed for play in Nevada unless it meets the minimum standards set forth in, for example, Technical Standards 1 and 2 and Regulations 5 and 14 issued pursuant to the Nevada Gaming Control Act. Additionally, the gaming machine and the casino wagering game must be approved by the commission pursuant to various provisions in Regulation 14. Comparable statutes, regulations, and technical standards exist in other gaming jurisdictions. As can be seen from the description herein, the gaming machine 10 may be implemented with hardware and software architectures, circuitry, and other special features that differentiate it from general-purpose computers (e.g., desktop PCs, laptops, and tablets).

Figure 4A:
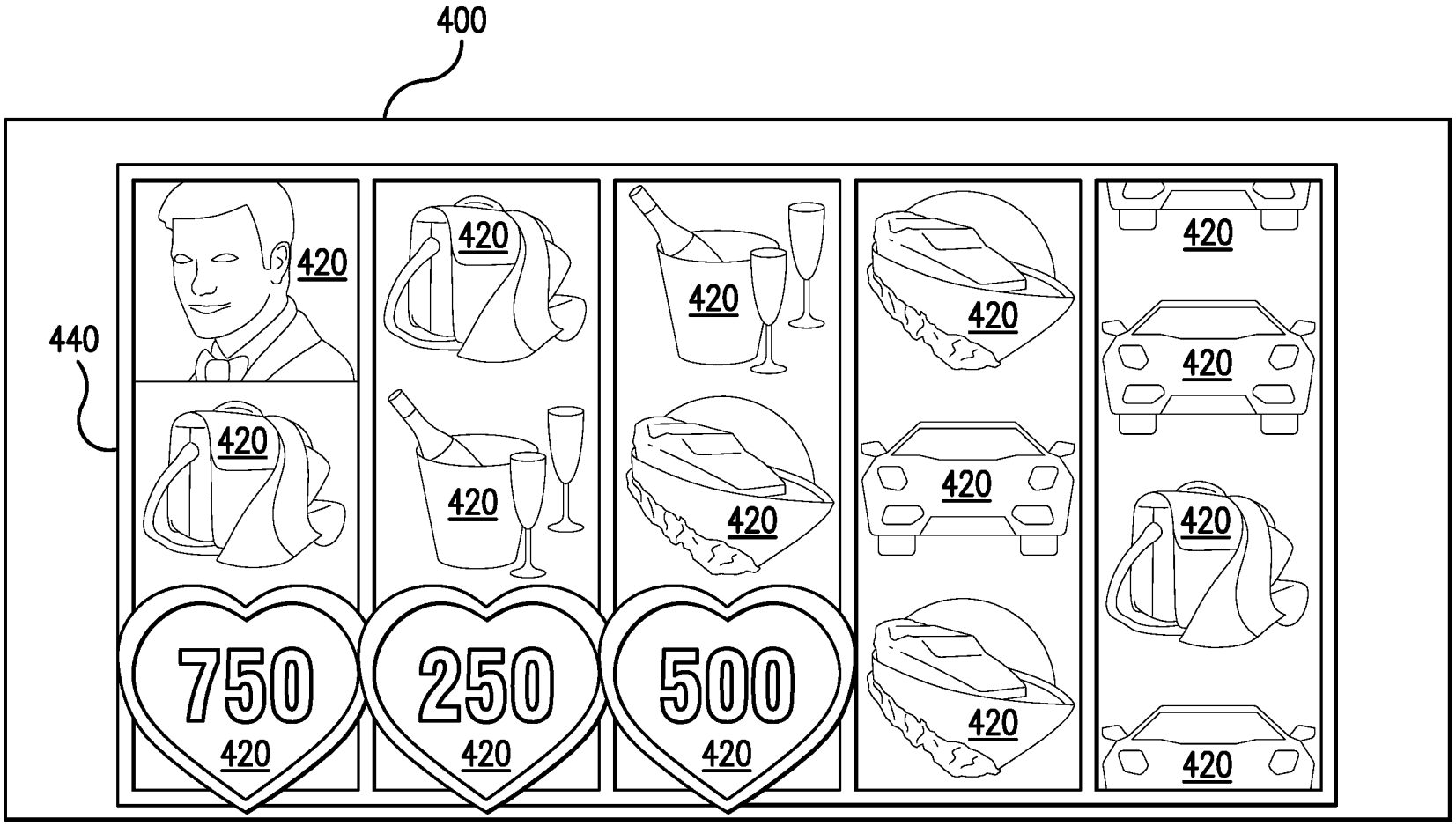
FIGS. 4A, 4B, 4C, 4D, and 4E are a series of illustrations of an exemplary feature game screen of a wagering game displayed on a gaming machine, according to one or more embodiments of the present invention.

Referring now to FIG. 4A-4F, in accordance with one or more embodiments, a series of displays associated with a feature game, which may be triggered as described above, are illustrated. Referring first to FIG. 4A, a bonus-game screen 400 portrays a plurality of game symbols 420 arranged in a matrix 440 adapted to be displayed on the primary display 18 or the secondary display 20. The symbols 420 of matrix 440 may be arranged for display, for example, by simulating the rotation and stopping of spinning reels bearing the game symbols 420. In one or more embodiments, matrix 440 may be randomly populated without the use of simulated reels. For example, game symbols 420 may be randomly or pseudo-randomly selected and placed directly into matrix 440. In still other embodiments, a combination of simulated reels and other means for presenting the population of matrix 440, such as direct placement, may be employed. In the exemplary illustration of FIG. 4A, matrix 440 includes five simulated symbol bearing reels which are each animated to rotate or "spin" in the five columns of matrix 440. As shown, each simulated reel may bear multiple game symbols 420 such that a segment of each reel is displayed in its respective column. Alternately, in some embodiments, each matrix position may be occupied by an individual reel. For example, the 15 matrix positions illustrated in FIG. 4A would comprise 15 reels, each one symbol high, which would each be animated to spin in its respective position in the matrix.

In the example of FIG. 4A, the symbols of the first four columns have stopped spinning, while the symbols in the fifth column, shown slightly out of alignment, have not yet reached their final resting positions in matrix 440. Though not shown, the bonus-game screen 400 also advantageously displays one or more game-session credit meters and various touch screen buttons adapted to be actuated by a player as also described above with respect to base-game screen 80. During presentation of the feature game, a player can operate or interact with the wagering game using these touch screen buttons or other input devices such as the buttons 26 shown in FIG. 1. The game-logic circuitry 40 operates to execute the feature game portion of the wagering-game program causing the primary display 18 or the secondary display 20 to display the feature game.

In the example feature game illustrated in FIGS. 4A-4F, and referring now to FIG. 4A. a certain number of value symbols such as any 3, 4 or 5 "heart" symbols are randomly placed on the same row of matrix 440 when the feature game is triggered. In one or more embodiments, the number of triggering symbols (for example, 3, 4, or 5) may also determine a number of feature game spins. In other embodiments, the number of spins awarded may be based on other factors, such as, but not limited to, the total credits wagered on the game. In the example of FIG. 4A, three value symbols have been placed in the lower left corner of matrix 440 as a result of a triggering condition. Each of the value symbols is assigned an initial numeric credit value, which is displayed upon each of the value symbols. For example, the value symbol at the bottom of the first column displays an initial value of 750 credits, the value symbol at the bottom of the second column displays an initial value of 250 credits, and the value symbol at the bottom of the third column displays an initial value of 500 credits. In some embodiments, the initial values assigned to each value symbol may be based on the total amount wagered on the game. For example, with 250 credits wagered on the game, the 250 credits assigned to the "heart" in the first column represents three times (3×) the value wagered on the feature game, the "heart" in the second column represents one times (1×) the value wagered on the feature game, and the "heart" in the third column represents two times (2×) the value wagered on the feature game. In some embodiments, the values assigned to the value symbol may be randomly selected before, during, or at the conclusion of the spin which triggers the feature play. In some embodiments, the values assigned may be randomly selected from a list of possible multipliers of the base wager, for example, 1×, 2×, 3×, 4×, 5×, 10×, 15×, 20×, 50×, and 100×. In still other embodiments, other methods may be employed to assign values to the value symbols. For example, they may be pre-assigned to each value symbol as part of the reel strip layouts of the feature game reels. In some embodiments of this type, which bonus reels to use for a particular spin of the feature game may be selected from a larger set of predefined reels.

Figure 4B:
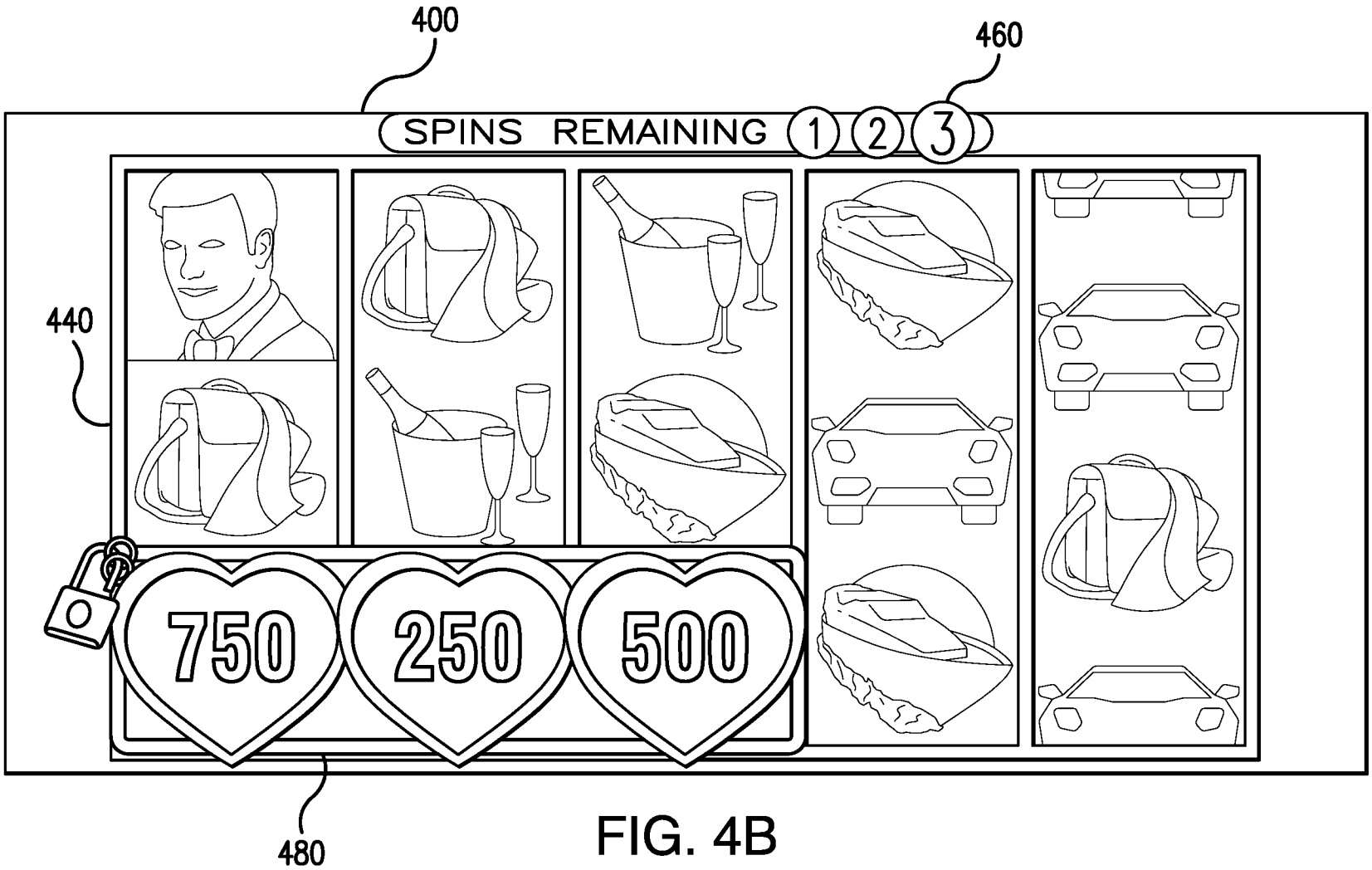

Referring now to FIG. 4B, in accordance with one or more embodiments, three bonus spins have been awarded, one for each triggering symbol, as shown in bonus spin meter 460. A border 480 has been placed around each of the adjacent triggering value symbols. During the bonus spins, these and any additional value symbols displayed on the matrix will be superimposed over their positions in matrix 440 (locked in place) and will replace any reel symbol appearing at their respective positions. If, at the conclusion of any of the three bonus spins, another value symbol has landed in a position horizontally or vertically adjacent to border 480, border 480 will expand to surround any new adjacent value symbols.

Though not shown, in some embodiments, a new border will surround any three or more value symbols outside of border 480 that are adjacent to one another. For each spin, if the number of surrounded value symbols has increased since the previous spin, the value assigned to each surrounded value symbol will increase. In one or more embodiments, the amount each value increases is equal to the number of credits wagered on the game, in this example, 250. In these and similar embodiments, such a fixed increment amount reduces how often the RNG must be used to determine the intermediate and final awards of the feature game. In some embodiments, if more than a certain number of value symbols appear on the screen, for example, 10, the amount each assigned value increases may be a higher multiple of the wager amount, for example, twice the wager amount. In other embodiments, other methods of increase, for example, random, may be employed. In still other embodiments, if the number of surrounded value symbols has increased since the previous spin, the number of remaining bonus spins may be reset to its original value (for example, 3, 4 or 5).

Figure 4C:
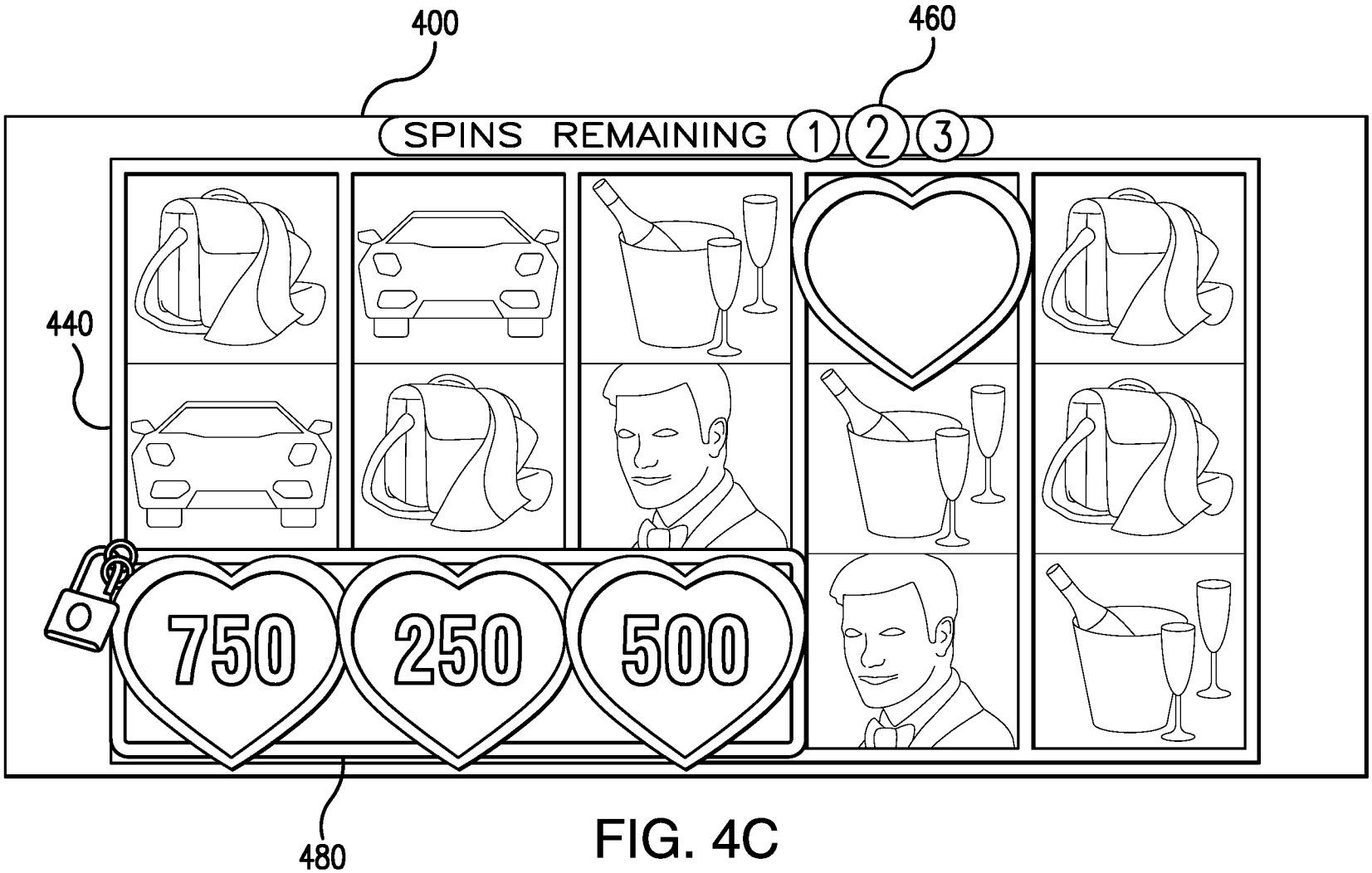

Referring now to FIG. 4C, in accordance with one or more embodiments, the simulated reels of matrix 440 have come to rest at the conclusion of the first of three free feature spins. The number of remaining bonus spins in bonus spin meter 460 has been decremented from 3 to 2. The three value symbols illustrated in FIG. 4B remained locked in place for the duration of the first bonus spin. An additional value symbol landed at the top of the fourth column of matrix 440. Since the number of surrounded value symbols (3) remained the same, the values assigned to each of the surrounded value symbols within border 480 remain unchanged and the number of remaining spins in bonus spin meter 460 was not reset to 3. Because the new single value symbol at the top of the fourth column has not landed horizontally or vertically adjacent to one of the triggering symbols to be surrounded by border 480, no credit value is assigned to it.

Figure 4D:
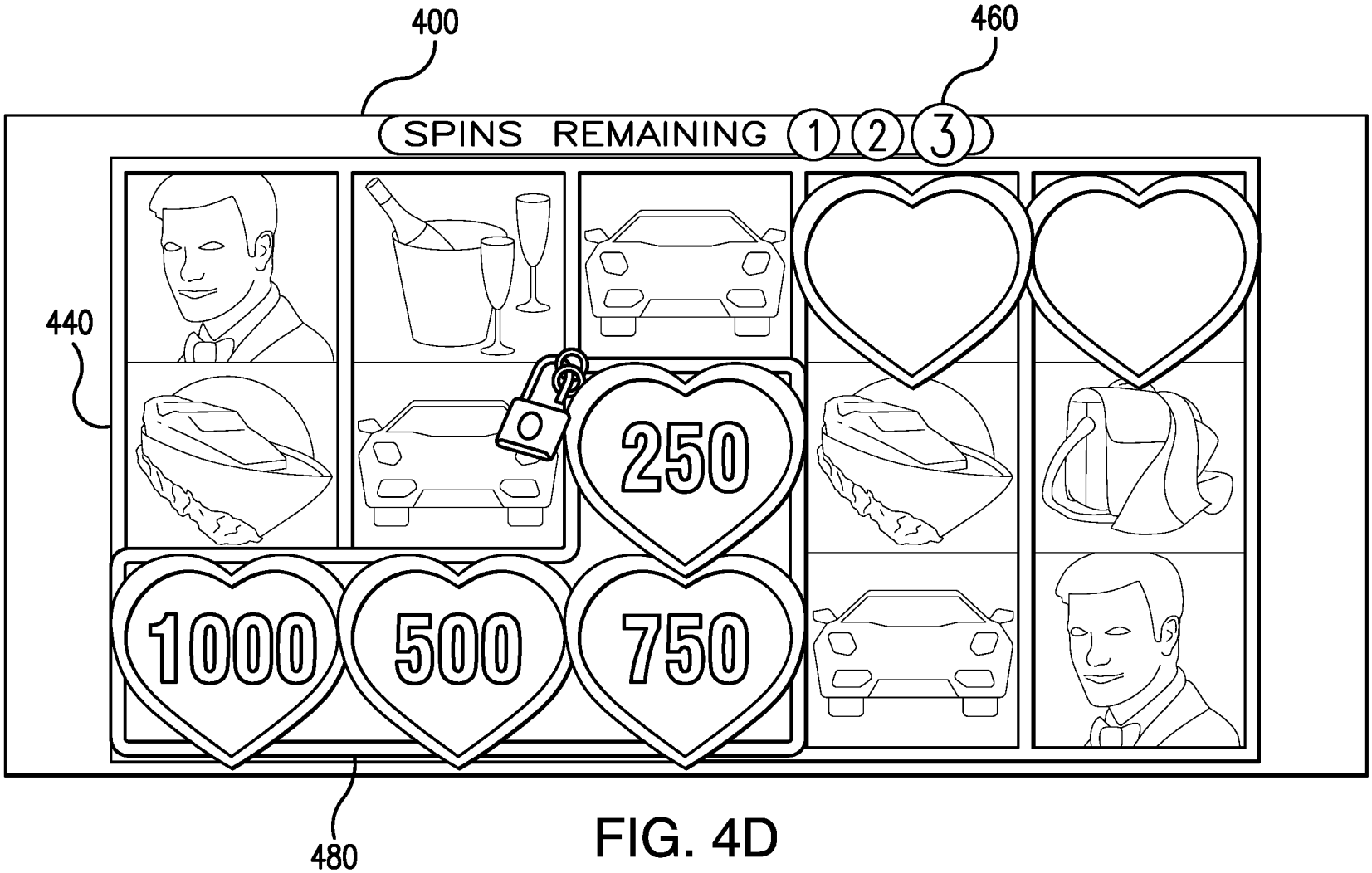

Referring now to FIG. 4D, in accordance with one or more embodiments, the simulated reels of matrix 440 have come to rest at the conclusion of the second of three free feature spins. The three value symbols illustrated in FIG. 4B remained locked in place for the duration of the second bonus spin. An additional value symbol landed in the second row of the third column of matrix 440. Another additional value symbol landed at the top of the fifth column of matrix 440. Since the value symbol in the third column is adjacent to border 480, border 480 has expanded to surround the new value symbol. An initial credit value of 250 credits has been assigned to the new value symbol, as described above. The original three value symbols within border 480 have had their original credit values increased from 750 to 1000, 250 to 500, and 500 to 750, respectively. Because the number of surrounded value symbols increased during the spin, the number of remaining spins in bonus spin meter 460 has been reset to 3. Because the value symbols at the top of the fourth and fifth columns are not one of the original triggering symbols and are not surrounded by a border, no credit values are assigned to them, though they will remain locked or held in place for subsequent spins.

Figure 4E:
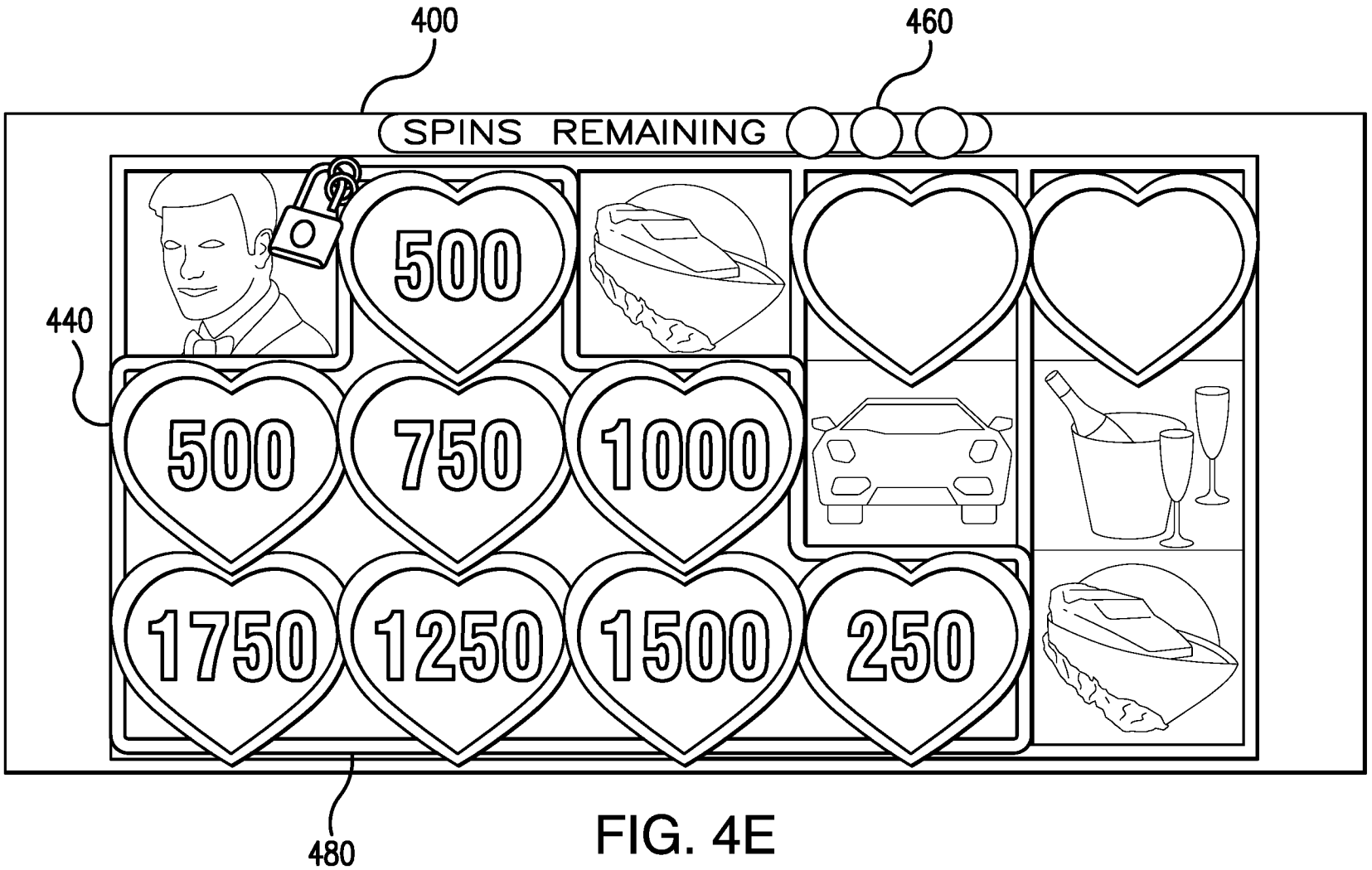

Referring now to FIG. 4E, in accordance with one or more embodiments, the simulated reels of matrix 440 have come to rest at the conclusion of the bonus feature because the number of bonus spins in bonus spin meter 460 decremented to 0. In accordance when one or more embodiments, the bonus feature may also conclude when at least a certain number of value symbols appear on matrix 440, for example, 15 value symbols. Over the course of several addition bonus spins, during which additional value symbols landed either horizontally or vertically adjacent to border 480, border 480 has expanded to surround a total of 7 value symbols.

The original three value symbols within border 480 have had their original credit values increased from 750 to 1750, 250 to 1250, and 500 to 1500, respectively. Other value symbols within border 480 have had their initially assigned credit values increased as well. Because the value symbols at the top of the fourth and fifth columns did not have a third (or more) value symbols land adjacent to them during any of the spins, they are not surrounded by a border and no credit values were assigned to them, though they remained locked in place during all spins after their initial appearance.

With the feature game at its conclusion, the values assigned to each of the value symbols are totaled (500+500+750+1000+1750+1250+1500+250) and an award of 7500 credit is added to the game's credit meter or otherwise awarded to the player of the game (as a hand pay, for example). During the feature game, non-value symbols are not active and are not used for evaluating for winning combinations according to a pay table.

Figure 4F:
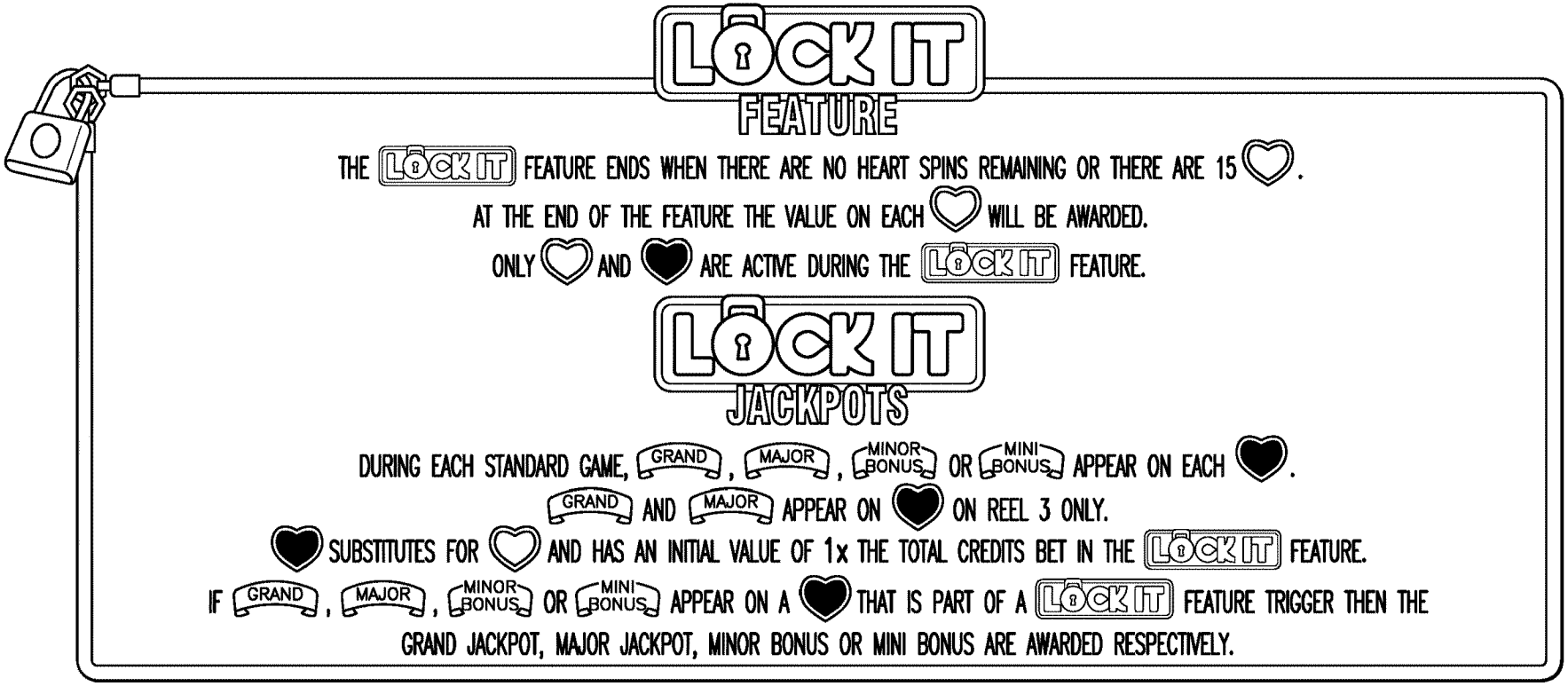
FIG. 4F is an example help screen according these one or more embodiments.

In accordance with one or more embodiments, instead of a credit value, a special annotation may be assigned to a particular value symbol, either when it first triggers the feature game, when it first appears adjacent to border 480 or when its value is increased as a result of subsequent spins. For example, a representation of a particular prize such as a mini-, minor-, major- or grand-bonus or jackpot, which may or not be a progressive prize, may be placed on the symbol in lieu of a credit amount. FIG. 4F provides a help screen illustrating non-limiting examples of these representations in accordance with one or more such embodiments.

While the above examples are described within the context of a feature game, it is equally contemplated that the invention can be practiced within the context of the basic wagering game. Though adjacent value symbols are grouped in the above example by surrounding them with a border, in one or more embodiments, a group is sufficiently formed if value symbols of a like type appear anywhere in the matrix, whether adjacent or not. In these embodiments, an indication that a value symbol is a member of a group may, as one non-limiting example, be shown graphically by highlighting each member of the group.

Figure 5:
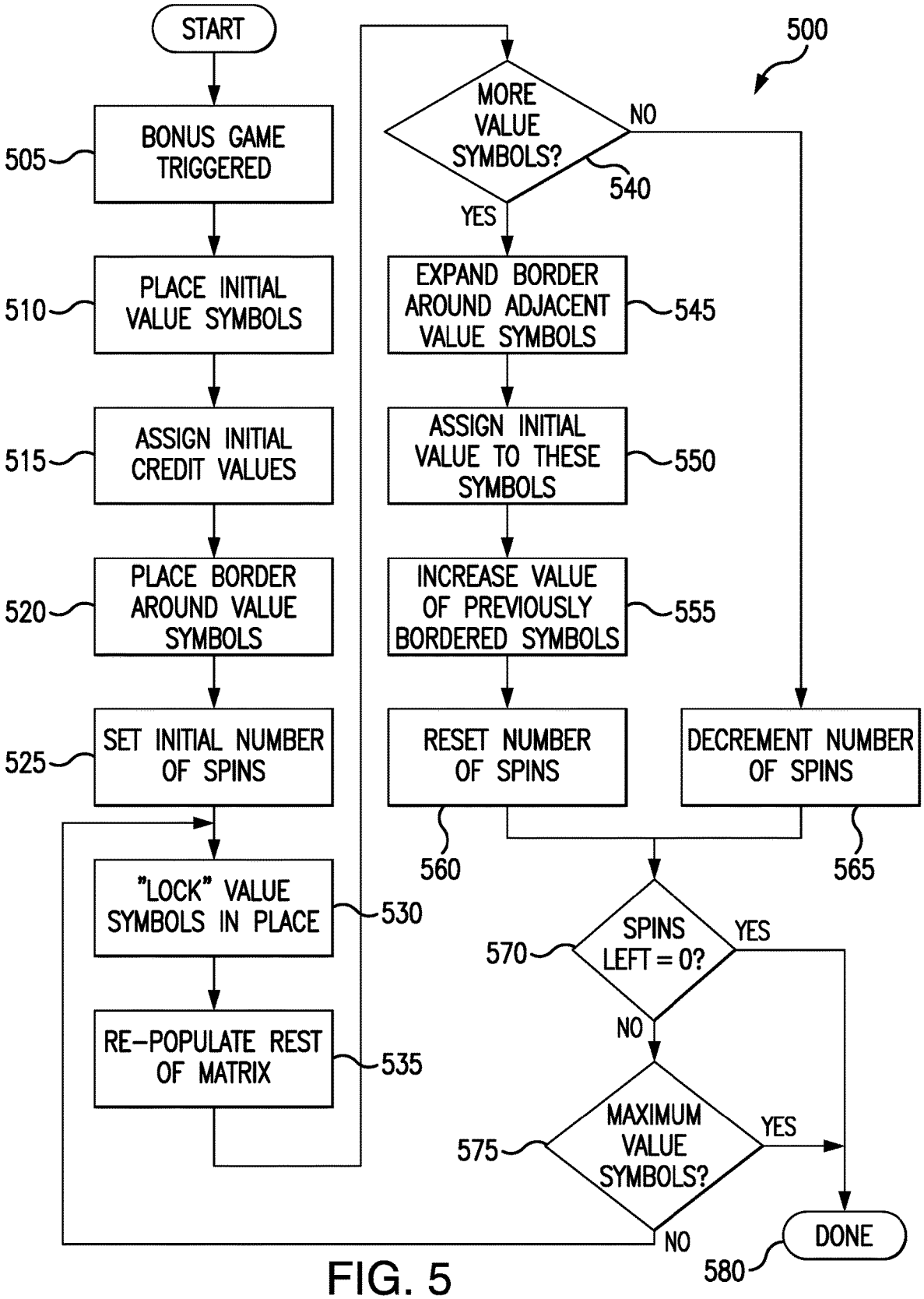
FIG. 5 is a flowchart for an algorithm that corresponds to instructions executed by a controller in accord with at least some aspects of the disclosed concepts.

FIG. 5, in accordance with one or more embodiments, represents one algorithm 500 that corresponds to at least some instructions stored and executed by the game-logic circuitry 40 in FIG. 2 to perform the above described functions associated with the disclosed concepts.

In block 505 of FIG. 5, a feature game is triggered by the wagering game, which may, as previously described, trigger bonus features based on one or more bonus triggering symbols appearing along an activated payline (i.e., "line trigger") or anywhere in the displayed array (i.e., "scatter trigger"). The wagering game may also provide mystery awards and features independent of the symbols appearing in its displayed array. The feature game may present one or more plays or "spins" to present a series of feature game outcomes. As in the example of FIG. 4A, a bonus-game screen may portray a plurality of game symbols arranged in a matrix. The symbols of the matrix may be arranged for display, for example, by simulating the rotation and stopping of spinning reels bearing the game symbols. In one or more embodiments, the matrix may be randomly populated without the use of simulated reels. For example, the game symbols may be randomly or pseudo-randomly selected and placed directly into the matrix. In still other embodiments, a combination of simulated reels and other means for presenting the population of the matrix, such as direct placement, may be employed In block 510, a certain number of value symbols, such as the 3, 4 or 5 "heart" symbols described above with respect to the example of FIG. 4A-E, are randomly placed adjacent to each other in the matrix. In one or more embodiments, the number of triggering symbols (3, 4, or 5) may also determine a number of feature game spins. In other embodiments, the number of spins awarded may be based on other factors, such as, but not limited to, the total credits wagered on the game. In the example of FIGS. 4A-E, three value symbols were placed in the lower left corner of matrix 440 as a result of a triggering condition.

In block 515, each of the value symbols is assigned an initial numeric credit value, which is displayed upon each of the value symbols. In the example of FIG. 4A, the value symbol at the bottom of the first column displayed an initial value of 750 credits, the value symbol at the bottom of the second column displayed an initial value of 250 credits, and the value symbol at the bottom of the third column displayed an initial value of 500 credits. In some embodiments, the initial values assigned to each value symbol may be based on the total amount wagered on the game. For example, with 250 credits wagered on the game, the 250 credits assigned to the "heart" in the first column represents three times (3×) the value wagered on the feature game, the "heart" in the second column represents one times (1×) the value wagered on the feature game, and the "heart" in the third column represents two times (2×) the value wagered on the feature game. In some embodiments, the values assigned to the value symbol may be randomly selected before, during, or at the conclusion of the spin which triggers the feature play. In some embodiments, the values assigned may be randomly selected from a list of possible multipliers of the base wager, for example, 1×, 2×, 3×, 4×, 5×, 10×, 15×, 20×, 50×, and 100×. In still other embodiments, other methods may be employed to assign values to the value symbols. For example, they may be pre-assigned to each value symbol as part of the reel strip layouts of the feature game reels. In some embodiments of this type, which bonus reels to use for a particular spin of the feature game may be selected from a larger set of predefined reels.

In block 520, a border or other designation groups each of the adjacent value symbols. During the bonus spins, these and any additional value symbols displayed on the matrix will be superimposed over their positions in the matrix (locked in place) and will replace any reel symbol appearing at their position. In one or more embodiments, the only active symbols during the bonus spins are the value symbols.

In block 525, the number of triggering symbols (for example, 3, 4, or 5) may be used to determine a number of feature game spins. In other embodiments, the number of spins awarded may be based on other factors, such as, but not limited to, the total credits wagered on the game.

In block 530, during the feature game spins, any value symbols currently displayed on the matrix will be superimposed over their positions in matrix (locked in place) and will replace any reel symbol appearing at their respective positions.

In block 535, any unlocked symbol positions of the matrix are repopulated by, for example, spinning the reels underlying any locked value symbols.

In decision block 540, it is determined whether any additional value symbols have been added to the matrix as a result of its repopulation. If not, flow proceeds to block 565, where the number of remaining bonus spins is decremented. Flow then proceeds to decision block 570. If, however, additional value symbols have been added to the matrix, any value symbols adjacent to the border around previously grouped adjacent value symbols is expanded to include the new adjacent symbols in block 545. In block 550, an initial value is assigned to the newly appearing value symbols within the border as described in the description of block 515.

In block 555, the values assigned to adjacent value symbols previously within the bordered area of the matrix are increased. In one or more embodiments, the amount each value increases is equal to the number of credits wagered on the game, for example, 250. In some embodiments, if more than a certain number of value symbols appear on the screen, for example, 10, the amount each assigned value increases may be a higher multiple of the wager amount, for example, twice the wager amount. In other embodiments, other methods of increase, for example, random, may be employed.

In decision block 560, a determination is made whether the number of remaining bonus spins has been exhausted. If yes, flow proceeds to block 580, where the feature game ends. If not, in accordance with some embodiments, an additional determination may be made whether the matrix currently displays more than a certain number (for example, 15) value symbols. If yes, flow proceeds to block 580, where the feature game ends. If no, flow proceeds to block 530, where another "spin" of the feature game occurs.

The order of actions as shown in FIG. 5 is only illustrative, and should not be considered limiting. For example, the order of the actions may be changed, additional steps may be added or some steps may be removed without deviating from the scope and spirit of the invention. In a further example, while the above algorithm is described within the context of a feature game, it is equally contemplated that the invention can be practiced within the context of the basic wagering game.

Figure 6:
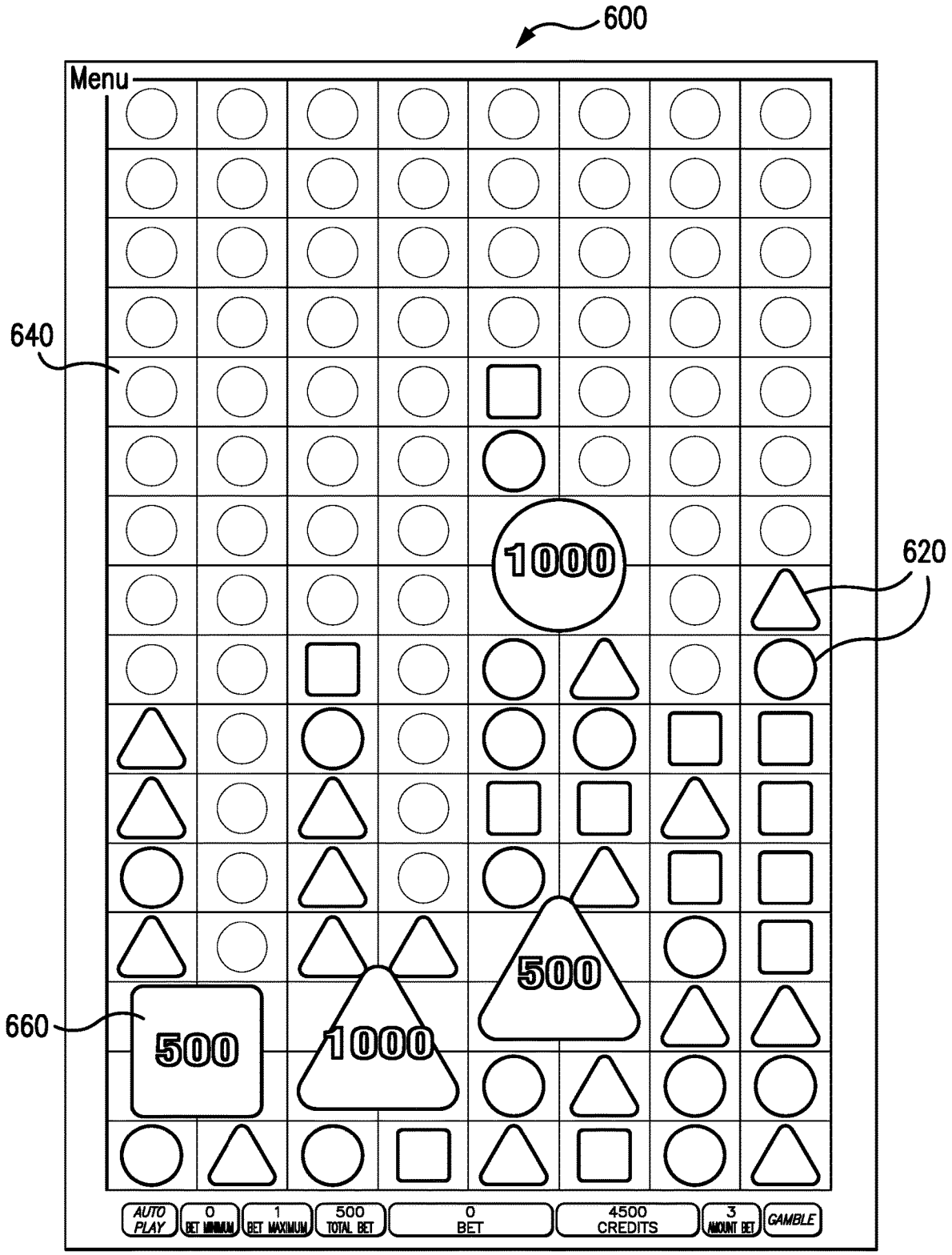
FIG. 6 is an illustration of an exemplary bonus-game screen of a wagering game displayed on a gaming machine, according to an embodiment of the present invention.

Referring now to FIG. 6, in accordance with one or more embodiments, an example of a display associated with the presentation of a feature game, which may be triggered as described above, are illustrated. In this variation of the feature game described above, instead of assigning individual credit values to adjacent value symbols, adjacent value symbols are grouped by fusing them together into a larger symbol to which a credit value is then assigned. In the example of FIG. 6, a bonus-game screen 600 portrays a plurality of game symbols 620 arranged in a matrix 640 adapted to be displayed on the primary display 18 or the secondary display 20. The symbols 620 of matrix 640 may be arranged for display, for example, by simulating the rotation and stopping of spinning reels bearing the game symbols 620. In one or more embodiments, matrix 640 may be randomly populated without the use of simulated reels. For example, game symbols 620 may be randomly or pseudo-randomly selected and placed directly into matrix 640. In still other embodiments, a combination of simulated reels and other means for presenting the population of matrix 640, such as direct placement, may be employed. In the exemplary illustration of FIG. 6, matrix 640 includes 128 simulated symbol bearing reels which are each animated to rotate or "spin" in the eight columns of matrix 640. As shown, each simulated reel may bear multiple game symbols 620 such that a one-symbol high segment of each reel is displayed in its respective position in matrix 640.

In this embodiment, the feature game is triggered when a particular number of bonus trigger symbols, for example, seven, appear during play of a base game (not shown). The trigger symbols are collected and randomly placed in positions of matrix 640 at the start of the feature game. The remaining individual reels spin to reveal value symbols 620 or blanks (in this example, value symbols 620 comprise gems of various colors and/or shapes). When all reels have been spun, any locations displaying non-blank symbols, in this case gems, will have their displayed symbols "fall" to the lowest non-blank position in their respective columns, leaving a blank symbol in their original positions. Matching gems fuse together when in a 2×2 or larger rectangle. Upon being fused together to create larger gem symbols, as illustrated, for example, by gem 660, a credit value is assigned to the fused symbol. Different types of gems may have values assigned to them based on a list of possible credit values associated with each gem type. In one or more embodiments, certain gems are wild and may substitute for any gem type for the purpose of creating fused gems. In accordance with one or more embodiments, the fusing of one or more gems may reset the number of free spins available during the feature game. In accordance with still other embodiments, the feature game may end when no gems appear during a set of spins or when the number of spins available decrements to zero. At the conclusion of the feature game, an award based on the displayed credit values on each of the fused gems is paid to the player. In accordance with some embodiments, a special award, which may include a progressive award, may be awarded in the case of the entire matrix 640 filling with gem symbols. In still other embodiments, various progressive awards may be assigned to fused gems of certain sizes. For example, a minor progressive may be assigned to a fused gem comprised of 6 original gems, whereas a larger progressive may be assigned to a fused gem comprised of 10 original gems.

Figure 7:
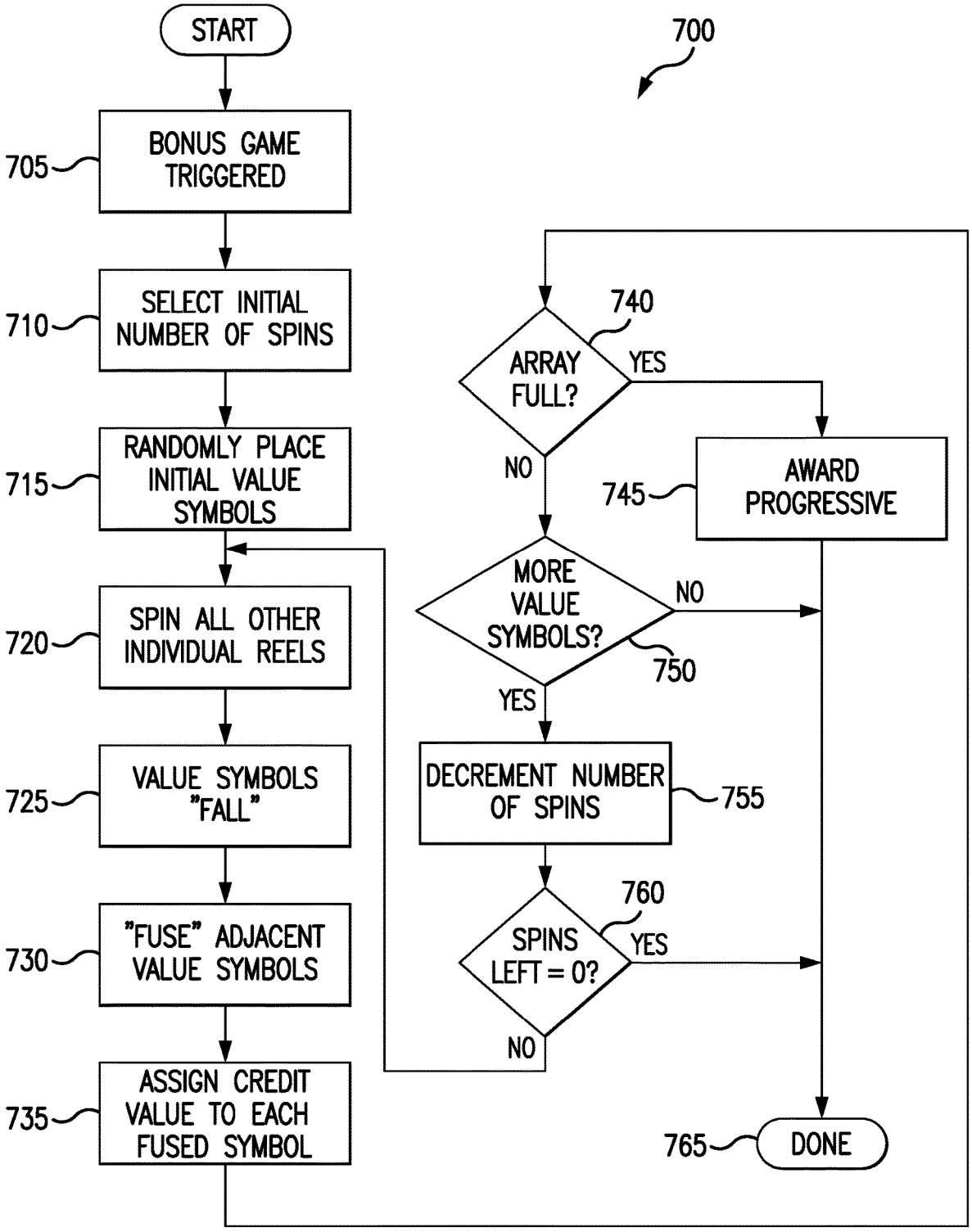
FIG. 7 is a flowchart for an algorithm that corresponds to instructions executed by a controller in accord with at least some aspects of the disclosed concepts.

FIG. 7, in accordance with one or more embodiments, represents one algorithm 700 that corresponds to at least some instructions stored and executed by the game-logic circuitry 40 in FIG. 2 to perform the above described functions associated with the disclosed concepts.

In block 705 of FIG. 7, a feature game is triggered by the wagering game, which may, as previously described, trigger bonus features based on one or more bonus triggering symbols appearing along an activated payline (i.e., "line trigger") or anywhere in the displayed array (i.e., "scatter trigger"). In accordance with one or more embodiments, triggering symbols may appear arranged in a certain pattern, for example, adjacent to each other in a 2×2 rectangle. The wagering game may also provide mystery awards and features independent of the symbols appearing in its displayed array. The feature game may present one or more plays or "spins" to present a series of feature game outcomes. As in the example of FIG. 6, a bonus-game screen may portray a plurality of game symbols arranged in a matrix. The symbols of the matrix may be arranged for display, for example, by simulating the rotation and stopping of spinning reels bearing the game symbols. In one or more embodiments, the matrix may be randomly populated without the use of simulated reels. For example, the game symbols may be randomly or pseudo-randomly selected and placed directly into the matrix. In still other embodiments, a combination of simulated reels and other means for presenting the population of the matrix, such as direct placement, may be employed In block 710, a number of bonus spins is determined. In one or more embodiments, the number of triggering symbols may be a factor in determining a number of feature game spins. In other embodiments, the number of spins awarded may be based on other factors, such as, but not limited to, the total credits wagered on the game.

In block 715, a certain number of value symbols, such as the "gem" symbols described above with respect to the example of FIG. 6, are randomly placed in the matrix. In some embodiments, the number and appearance of the value symbols are representative of the triggering symbols, in other embodiments, their number and appearance are independently determined.

In block 720, the unpopulated symbol positions of the matrix are populated by, for example, spinning the reel associated with each unpopulated symbol position.

In block 725, when all the remaining reels have been spun, any locations displaying non-blank symbols, in this case gems, will have their displayed symbols "fall" to the lowest non-blank position in their respective columns, leaving a blank symbol in their original positions.

In block 730, matching adjacent value symbols fuse together when in a 2×2 or larger rectangle. In one or more embodiments, different types of gems may have values assigned to them based on a list of possible credit values associated with each gem type. In some embodiments, certain gems are wild and may substitute for any gem type for the purpose of creating fused gems. After being fused together to create larger value symbols, a credit value is assigned to the fused symbol in block 735.

In decision block 740, it is determined whether the array is full of value symbols. If so, a special award, for example, a progressive award, may be awarded at block 745 and the feature game is terminated at block 765.

If the array is not full, in decision block 540, it is determined whether any additional value symbols have been added to the matrix as a result of spins that occurred in block 720. If not, the feature game is terminated at block 765. If so, flow proceeds to block 755, where the number of remaining bonus spins is decremented.

In decision block 760, a determination is made whether the number of remaining bonus spins has been exhausted. If yes, flow proceeds to block 765, where the feature game ends. If no, flow proceeds to block 720, where another "spin" of the feature game occurs.

The order of actions as shown in FIG. 7 is only illustrative, and should not be considered limiting. For example, the order of the actions may be changed, additional steps may be added or some steps may be removed without deviating from the scope and spirit of the invention. In a further example, while the above algorithm is described within the context of a feature game, it is equally contemplated that the invention can be practiced within the context of the basic wagering game.

Figure 8A:
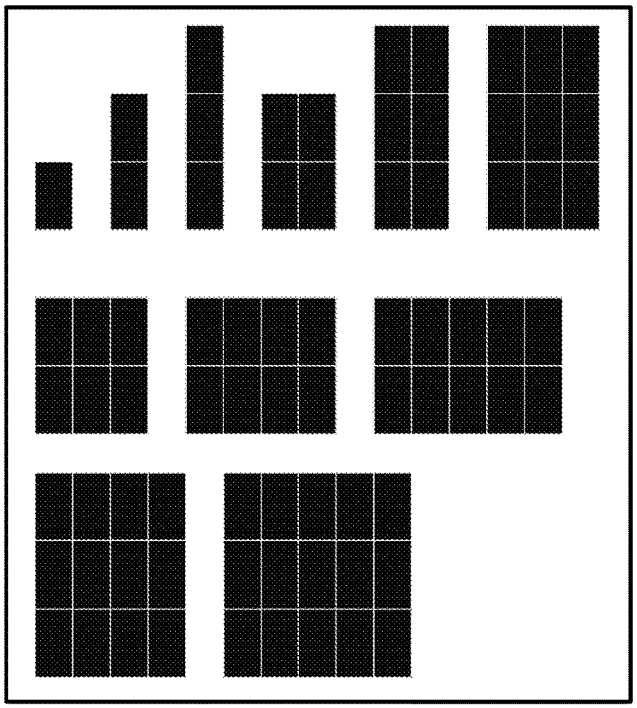
FIGS. 8A and 8B provide examples of grouping value symbols according to rules and hierarchies in accord with at least some aspects of the disclosed concepts.

In accordance with other embodiments employing fused symbols, when a feature game trigger occurs, the value symbols are placed and then held in place in the matrix. All other symbols are replaced by a random selection of blank/greyed out symbols from the base game. Any value symbols that are adjacent to each other are then automatically fused to create larger symbols in shapes, for example, shown in FIG. 8A.

Figure 8B:
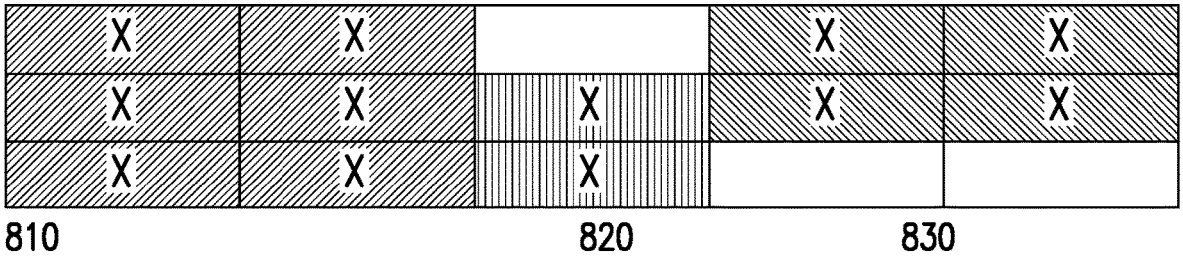

In accordance with some embodiments, fused symbols are formed according to defined 'blocks' of symbols (2×1; 3×1; 2×2; etc.), where blocks are formed in an order of preference, for example, based on size, then height. For example, if value symbols had landed in the array of FIG. 8B in the "X" marked locations, a fused 3×2 block 810, a fused 2×1 block of symbols 820 and a fused 2×2 block of symbols 830 would be formed. Although a 2×3 block of symbols could have been formed using the above arrangement instead, the 3×2 block 810 is taller and takes precedence in being formed over a 2×3 block. Other rules of precedence may be employed.

Once all value symbol transformations are complete, a number of additional spins are awarded, as described above. Individual reels will spin in each of the symbol positions and only value symbols or a blank/greyed out symbol will appear on each reel. Any additional value symbols that land are held for the duration of the feature game and those that land adjacent to existing value symbols will automatically transform into larger fused symbols as indicated above.

In accordance with one or more embodiments, when a value symbol is held in position as indicated above, it may be designated as occupying a first layer at its location on the matrix. An individual reel associated with the location will still spin during each subsequent play of the feature game. Should another value symbol land in a position in the matrix already occupied by a held value symbol, the new value symbol may be designated as occupying a second layer at that location. Value symbols that land in each layer are held for the duration of the feature game and those that land adjacent to existing value symbols in their respective layer will automatically transform into larger fused symbols as indicated above.

Once all spins are complete, a reel associated with each fused symbol (in one or more layers) is revealed and spun to determine a prize for the fused symbol. Each symbol on this reel represents a potential credit prizes or progressive jackpots. The larger a fused symbol, the larger the credit prizes or progressive jackpots available on the reel. All determined prizes are held until all value symbol reels have been spun and prizes determined, at which point the total of all of the sub-prizes is awarded and the feature game ends.

Each of these embodiments and obvious variations thereof is contemplated as falling within the spirit and scope of the claimed invention, which is set forth in the following claims. The present concepts also expressly include any and all combinations and sub-combinations of the preceding elements and aspects.

What is claimed is:

1. A gaming system, comprising:

a regulated gaming machine primarily dedicated to playing at least one casino wagering game, the gaming machine including an electronic display device and one or more electronic input devices; and game-logic circuitry configured to:

detect, via at least one of the one or more electronic input devices, a physical item associated with a monetary value that establishes a credit balance;

initiate the casino wagering game in response to an input indicative of a wager covered by the credit balance;

randomly select a set of symbols from a plurality of symbols, the plurality of symbols including standard symbols and value symbols, the value symbols being associated with one or more values;

display the set of symbols in an array on the electronic display device;

create one or more groups from one or more adjacent displayed value symbols and hold each group in place on the electronic display device;

replace one or more of the displayed standard symbols with respective replacement symbols randomly selected from the plurality of symbols; and only in response to the replacement symbols including another one or more of the value symbols in an array position immediately adjacent to at least one of the one or more groups:

add the another one or more of the value symbols to the immediately adjacent group to increase the number of value symbols in that group; and modify at least one of the values of the symbols previously in the immediately adjacent group;

modify the credit balance by an amount comprising a total of the values of the symbols in the one or more groups; and receive, via at least one of the one or more electronic input devices, a cashout input that initiates a payout from the credit balance.

2. The gaming system of claim 1, wherein a value initially associated with each value symbol in each held group is either randomly selected from a set of possible values or is fixed value.

3. The gaming system of claim 1, wherein all value symbols are held in place on the electronic display device.

4. The gaming system of claim 1, wherein the game logic circuitry is further configured to form at least one additional group in response to the replacement symbols including another one or more of the value symbols in an array position immediately adjacent to other value symbols not already in a group.

5. The gaming system of claim 1, wherein modifying at least one of the values of the symbols previously in the immediately adjacent group comprises increasing the at least one of the values by a fixed amount.

6. The gaming system of claim 1, wherein the game-logic circuitry is further configured to predetermine an initial number of plays and assign the initial number of plays to a number of remaining plays, to decrement the number of remaining plays each time one or more of the displayed standard symbols is replaced with a respective replacement symbols randomly selected from the plurality of symbols, and to reset the number of remaining plays to the initial number of plays in response to the replacement symbols including another one or more of the value symbols in an array position immediately adjacent to at least one of the one or more groups.

7. A method of operating a gaming system, the gaming system including game-logic circuitry and a regulated gaming machine, the gaming machine primarily dedicated to playing at least one casino wagering game, the gaming machine including an electronic display device and a value input device, the method comprising:

detecting, via at least one of the one or more electronic input devices, a physical item associated with a monetary value that establishes a credit balance;

initiating the casino wagering game in response to an input indicative of a wager covered by the credit balance;

randomly selecting a set of symbols from a plurality of symbols, the plurality of symbols including standard symbols and value symbols, the value symbols being associated with one or more values;

displaying the set of symbols in an array on the electronic display device;

creating one or more groups from one or more adjacent displayed value symbols and holding each group in place on the electronic display device;

replacing one or more of the displayed standard symbols with respective replacement symbols randomly selected from the plurality of symbols; and only in response to the replacement symbols including another one or more of the value symbols in an array position immediately adjacent to at least one of the one or more groups, adding the another one or more of the value symbols to the immediately adjacent group to increase the number of value symbols in that group; and modifying at least one of the values of the symbols previously in the immediately adjacent group;

modifying the credit balance by an amount comprising a total of the values of the symbols in the one or more groups; and receiving, via at least one of the one or more electronic input devices, a cashout input that initiates a payout from the credit balance.

8. The method of claim 7, wherein a value initially associated with each value symbol in each held group is either randomly selected from a set of possible values or is fixed value.

9. The method of claim 7, wherein all value symbols are held in place on the electronic display device.

10. The method of claim 7, wherein the game logic circuitry is configured to form at least one additional group in response to the replacement symbols including another one or more of the value symbols in an array position immediately adjacent to other value symbols not already in a group.

11. The method of claim 7, wherein modifying at least one of the values of the symbols previously in the immediately adjacent group comprises increasing the at least one of the values by a fixed amount.

12. The method of claim 7, further comprising the steps of predetermining an initial number of plays and assigning the initial number of plays to a number of remaining plays, of decrementing the number of remaining plays each time the replacement step is performed and of resetting the number of remaining plays to the initial number of plays in response to the replacement symbols including another one or more of the value symbols in an array position immediately adjacent to at least one of the one or more groups.

13. A gaming system, comprising:

a regulated gaming machine primarily dedicated to playing at least one casino wagering game, the gaming machine including an electronic display device and one or more electronic input devices; and means for:

detecting, via at least one of the one or more electronic input devices, a physical item associated with a monetary value that establishes a credit balance;

initiating the casino wagering game in response to an input indicative of a wager covered by the credit balance;

randomly selecting a set of symbols from a plurality of symbols, the plurality of symbols including standard symbols and value symbols, the value symbols being associated with one or more values;

displaying the set of symbols in an array on the electronic display device;

creating one or more groups from one or more adjacent displayed value symbols and hold each group in place on the electronic display device;

replacing one or more of the displayed standard symbols with respective replacement symbols randomly selected from the plurality of symbols; and only in response to the replacement symbols including another one or more of the value symbols in an array position immediately adjacent to at least one of the one or more groups:

adding the another one or more of the value symbols to the immediately adjacent group to increase the number of value symbols in that group; and modifying at least one of the values of the symbols previously in the immediately adjacent group;

modifying the credit balance by an amount comprising a total of the values of the symbols in the one or more groups; and receiving, via at least one of the one or more electronic input devices, a cashout input that initiates a payout from the credit balance.

14. The gaming system of claim 13, wherein a value initially associated with each value symbol in each held group is either randomly selected from a set of possible values or is fixed value.

15. The gaming system of claim 13, wherein all value symbols are held in place on the electronic display device.

16. The gaming system of claim 13, further comprising means for forming at least one additional group in response to the replacement symbols including another one or more of the value symbols in an array position immediately adjacent to other value symbols not already in a group.

17. The gaming system of claim 13, wherein modifying at least one of the values of the symbols previously in the immediately adjacent group comprises increasing the at least one of the values by a fixed amount.

18. The gaming system of claim 13, further comprising means for predetermining an initial number of plays and assigning the initial number of plays to a number of remaining plays, for decrementing the number of remaining plays each time one or more of the displayed standard symbols is replaced with a respective replacement symbols randomly selected from the plurality of symbols, and for resetting the number of remaining plays to the initial number of plays in response to the replacement symbols including another one or more of the value symbols in an array position immediately adjacent to at least one of the one or more groups.

* * * * *